US005848401A

United States Patent [19]

Goldberg et al.

[11] Patent Number: 5,848,401

[45] Date of Patent: Dec. 8, 1998

[54] HAND-HELD PORTABLE POSTAGE METER THAT USES PRE-PRINTED TAPE

[76] Inventors: Robert M. Goldberg, 120 Orleans La., Jericho, N.Y. 11753; Jerome R. Rosenberg, 50 Park Ave., New York, N.Y. 10016

[21] Appl. No.: 755,697

[22] Filed: Nov. 25, 1996

Related U.S. Application Data

[63] Continuation of Ser. No. 577,829, Dec. 22, 1995, abandoned.

[51] Int. Cl.[6] ..... G07B 17/00

[52] U.S. Cl. ..... 705/408; 101/71; 283/71

[58] Field of Search ..... 101/71; 221/71; 283/71; 364/400, 479.01, 479.02, 479.03, 479.05; 705/400, 401, 404, 408, 410

[56] References Cited

U.S. PATENT DOCUMENTS

| | | | |
|---|---|---|---|
| 3,524,406 | 8/1970 | Traynor | 101/93 |
| 3,595,167 | 7/1971 | Wirth | 101/287 |
| 3,921,516 | 11/1975 | Toft et al. | 101/91 |
| 4,024,380 | 5/1977 | Gunn | 235/432 |
| 4,168,533 | 9/1979 | Schwartz | 364/705 X |
| 4,470,530 | 9/1984 | Wologodzew | 226/165 |
| 4,506,344 | 3/1985 | Hubbard | 364/708 X |
| 4,511,793 | 4/1985 | Racanelli | 705/404 |
| 4,872,119 | 10/1989 | Kajimoto | 364/464.03 |
| 4,900,903 | 2/1990 | Wright et al. | 235/380 |
| 5,122,967 | 6/1992 | Gilham | 364/479.05 |
| 5,271,322 | 12/1993 | Palma | 101/93 X |
| 5,283,744 | 2/1994 | Abumehdi et al. | 364/464.02 |
| 5,339,734 | 8/1994 | Mustafa et al. | 101/109 |
| 5,365,044 | 11/1994 | Hesshaus | 235/375 |
| 5,373,450 | 12/1994 | Gallagher et al. | 364/464.02 X |
| 5,408,416 | 4/1995 | Gilham | 705/406 |
| 5,479,586 | 12/1995 | Gallagher et al. | 395/111 |
| 5,490,077 | 2/1996 | Fretag | 705/404 |
| 5,508,933 | 4/1996 | Abumehdi | 364/464.02 |

OTHER PUBLICATIONS

"Three–Month Free Trial", Pitney Bowes, 40 Lindeman Drive, Trumbull, Ct. 06611–4785, 2 page brochure, (No Date).

"Speedy Postage Meter Puts Out Time–Saving Professional Mail", Pitney Bowes, 40 Lindeman Drive, Trumbull, Ct. 06611–4785, 2 page brochure, (No Date).

*Primary Examiner*—Edward R. Cosimano
*Attorney, Agent, or Firm*—John D. Upham

[57] ABSTRACT

A highly secure hand-held portable postage meter is disclosed that uses partially pre-printed postal tape. Only the date and postage amount remain to be printed on the tape by the meter. The postal tape, pre-printed by Postal Authority, is enclosed within the meter in a removable cartridge. In one embodiment, a new cartridge being pushed into the meter pushes the used cartridge out. An anti-tamper lock is released by a probe key, on the leading face of the cartridge, that couples with a receptor on the trailing face of the used cartridge.

21 Claims, 7 Drawing Sheets

HAND-HELD PORTABLE POSTAGE METER THAT USES PRE-PRINTED TAPE

This application is a continuation of our application Ser. No. 08/577,829, filed Dec. 22, 1995, now abandoned the entire contents of which is hereby incorporated herein by reference.

BACKGROUND

Postal systems grant a franking privilege (the right to have mail delivered) to those who pay proper postage. The proper amount of postage depends upon the weight, destination, and nature (class) of the mail. Self-adhesive and water-base glued stamps of fixed denomination, as well as metered stamps printed in varying denomination, are available for purchase at post offices. These stamps serve as proof that payment was made, and, in the case of commemorative stamps, may have numismatic value for collectors.

In the United States, businesses and other users of large numbers of stamps of varying denomination can avoid frequent trips to the post office by leasing a postage meter from an authorized private contractor. Leased postal meters contain a continuous roll of blank, approved postal meter tape upon which the selected amount of postage, the date, and possibly other numerical data, together with graphical material contained on an indicial plate, are printed. These machines are large, table-top units, are inspected on a monthly basis, and have elaborate means for preventing fraudulent use of the franking privilege.

The falling cost and increasing capability of electronic technology has generated the desire to provide the advantages of a postage meter to a wider range of postal patrons. Several U.S. patents have dealt with hand-held, portable postage meters, which use microcomputer technology to process data and control operation of the meter. Understandably, none of these has been commercialized. The small size and light weight of a portable postage meter, as well as its ubiquity, exacerbate the problem of preventing fraud, while the complexity of available, graphical printing means provide a challenge to produce a reasonably price instrument.

U.S. Pat. No. 4,506,344 (Hubbard) limits one type of fraud by enclosing the printer within locked doors. Only when the correct numerical code is entered at the meter's key pad and there is sufficient postage remaining in the debit register will the doors open so the printer can contact the meter tape, letter, or package.

U.S. Pat. No. 4,168,533 (Schwartz) uses a microcomputer to drive an ink jet printer that is capable of producing entire stamps—graphical indicia, as well as any alphabetic and numeric data. The cost and complexity of this type of printer may be the reason that it has not been commercially realized in a hand-held meter.

U.S. Pat. No. 5,271,322 (Palma) teaches a disposable stamp marker that stamps a fixed preset amount onto a piece to be mailed along with an impression of an official government seal. A pulse counter with a preset limit displays the number of stamps remaining, and when it reaches zero the marker stamp is destroyed.

OBJECTS OF THE INVENTION

It is an object of the invention to make a practical hand held and portable postage meter.

It is an object of the invention to produce a postage meter that incorporates security means that are simple enough, and yet sufficient, that fraud will not be a serious consideration.

It is an object of the invention to produce a postage meter that incorporates partially pre-printed postal meter tape, so that simple and inexpensive numerical printing means for amount and date can be employed.

It is an object of the invention to provide a postage meter that can dispense commemorative postage stamps and so continue the postal stamp numismatic tradition.

SUMMARY OF THE INVENTION

The present invention provides improved postage meters, preferably hand-held. The invention reduces the problem of protecting against the fraudulent use of the meter's printing means, by only printing numerical data onto postal meter material and not directly onto mail or packages. It introduces the use of partially pre-printed, discrete meter material, rather than using continuous, blank postal meter tape according to current practice. This measure shifts a major security problem, away from the prevention of unaccounted-for printing, to controlling access to the supply of pre-printed postal meter material.

Partially printed postal meter material is similar to ordinary, fixed denomination postage stamps, in that: each of these has graphic material; each, when provided on rolls can have tear-off perforations; each can be printed and maintained in bulk, under controlled security. But the postal denomination of meter stamps is variable and is printed by the postage meter itself in amounts selected by the patron. The date and other printing may also be variable. A variety of different commemorative material can be offered, in color if desired, giving the stamps produced by these postage meters numismatic value.

Postal authority can make pre-printed, partially printed, postal meter material available, in several forms:

1) as a continuous roll of tape carrying adhesive on the back side, with perforations separating the completed stamps for easy tear removal, for material that requires moistening;
2) as a continuous roll of tape, including a release non-stick backing, for self adhering material;
3) as separate, already-cut media, stacked in a magazine for convenient dispensing.

The United States Postal Service has an admirable record of operating closed facilities where pre-printed material can be accounted for. Another advantage of only producing stamps on pre-printed media, and not directly onto letters or packages, is that the printer will not become contaminated with dirt that may be present on letters or packages.

A supply of such partially pre-printed postal meter material is installed in a meter, where numerical data are added to form a complete postage stamp. In one embodiment of the invention, partially printed postal meter tape is dispensed from a roll which may be contained within a removable cartridge. The cartridge can be inserted into the postage meter by postal authority at the time that the meter's debit register is recharged to a specified amount of postage or its accumulator is read out and reset. The term "postal authority" as used herein means official authority, e.g. the U.S. Postal Service, and its designees, such as authorized private contractors or authorized individual users.

Various types of printer may be used in a hand-held portable postage meter of the type described in the present invention. It needs to be small, energy efficient, and low cost. In addition, the printing must be secure—there must be little possibility of producing unaccounted for stamps. This aim can be achieved by tightly, physically linking the printing, to one-way accounting devices that are not volatile.

An important feature of a preferred embodiment of the invention is the provision of opposed openings in the housing of the meter, for the insertion and removal of a tape cartridge, whereby as shown in FIG. 3*b*, a used cartridge 21 is removed through one opening by being pushed out by a new cartridge 22 entering through the opening in the opposite side. Between the two openings means are provided to guide the cartridges as they are moved in and out, or the openings can be joined by a cylinder of the same shape as but slightly larger than the cross-section of the cartridges. When a cartridge is in place its ends form a tight seal with and may be flush with the outside surfaces of the housing. Secure means can also be provided for a cartridge which is inserted and removed through the same opening in the meter body.

Our postage meters can have various features: the printing of variable selected postage, the date, serial number or other security marking, and an advertising message; the calculation of postage based upon destination, weight, and class; the direct weighing of the item; various ways of arranging for the payment of stamps printed, that is, the administration of the system. The administration of a system for hand-held postage meters can include: a pre-paid amount held in a charge register that is debited by the amount of each printed stamp; an accumulative register that totals the amount of each printed stamp and which is reset periodically when the amount of postage due is paid. To ensure that all the stamps which are printed are paid for, can involve identifying the user and/or limiting printing to definite, recorded amounts. The use of our postage meters can be restricted to a particular individual or to anyone possessing the correct physical token, such as a data card or a mechanical key. The printing of a serial number on each metered postage stamp, that can identify that particular meter and perhaps even that particular stamp, has been suggested as an effective way to deal with fraud.

A number of existing schemes can restrict the use of an instrument to a particular individual by comparing one of their body's characteristics, such as a finger or hand or facial image, to previously stored data. Only when a match occurs is the instrument enabled for use.

An encoded data card, either of a passive or active type can serve to enable our instrument. The more widely-used passive cards are often based on a layer of encoded material that is bonded between two inert plastic layers. The encoding is usually based on the pattern of magnetization or of stored electrostatic charge held within the sandwiched material. Passive cards can be either "read-only" or be "read-and-write." In the latter case, a personal identification number (PIN) can be entered or changed periodically. For someone to use the instrument requires that a card be inserted, and that the proper PIN be entered on a key pad or otherwise.

The encoded layer of an active or "smart" card contains semiconductor circuits, either with an integral battery providing power or with contacts which allow connection to power from an external source. Smart cards include a microprocessor or other complex logic circuitry and have both volatile and non-volatile memory circuits. These processing circuits permit a smart card to update and store transactions so that the charge register or accumulator and/or the results of debit or accumulate accounting functions can reside in the insertable active card, which can serve to simplify an instrument.

Printing means available for our hand-held, portable postage meter include: mechanical contact types with linear or circular access to the media to be printed upon and which typically have a set of raised alphabetic, numeric, and special characters; contact indicial plates, some of which are made to be changeable; various electronic and electrochemical technologies, with graphic capability, including, dot matrix, ink jet, thermal, thermal transfer, and laser electrostatic types.

Our means for entering data or selecting control options, include: discrete data entry key pads and key boards, including those which are sensitive to heat, pressure, or touch proximity; rotating or sliding mechanical; positional types with either analog or digital electrical transduction; those which are menu-driven from an electronic display with any of the above means used for indicating a selection. The latter means include those with manual input to screen-actuated positional control.

Fraud Prevention

Our postage meter provides several levels of fraud prevention, including: deterrence, invalidation, and security. Aspects of each approach exist and will be described below, roughly in the order given.

The fact that a meter patron must return an integral cartridge in order to obtain additional pre-printed meter material will strongly deter tampering.

Effective deterrence against fraud is linked to the amount of profit to be gained. Portable postage meters only hold a small amount of pre-printed postal meter material relative to that in table-top models. The maximum value of a stamp that can be printed can be restricted to a reasonable amount by physically limiting the printer to, say, $9.99, $3.99, $1.00, or less. Infrequently needed, larger amounts of postage can consist of two or more stamps.

The use of pre-printed meter material means that meter stamps cannot be easily counterfeited. The pre-printed meter material will be printed by the postal authorities using high quality ink and printing means and can contain graphic material that is difficult to reproduce. Serial numbers or marks can be applied that identify individual postage meters or individuals. Furthermore, if one were inclined to defraud the Postal Authority by counterfeiting stamps, a much more attractive target would be ordinary, complete, fixed denomination stamps.

The removable cartridge of postal meter tape may contain an ink pad or a reservoir of ink. This is illustrated in FIG. 2, where a contact printer is shown. Thus, the replacement of a cartridge of postal meter tape will, in meters with inked type, also ensure that ink is always available for printing. Fluorescent ink is currently required by the U.S. Postal Service.

As illustrated by the ink release, 12, in FIG. 3*a*, an ink reservoir may also provide a security feature. If an attempt is made to remove the cartridge from the postage meter without inserting the proper key, which preferably is contained in the leading face of new cartridges, ink is automatically dispensed from the reservoir, 5, via ink release, 12, onto the edges of the roll of postal meter tape or stack of discrete media, and/or over the print mechanism. This permanently invalidates the tape, cancels the franking privilege, and/or leaves the print capability in questionable condition. The invalidation of the residue of the tape, by the inking of the edges, can be performed whenever a cartridge is replaced, or only in response to unauthorized attempts to acquire tape from the meter or to otherwise tamper with the meter. Selection of the absorbency of the meter paper and/or selection of more viscous ink can ensure that, in meters with inked type, the roll of meter tape is sufficiently marred when ink is dispensed, while still producing crisp print in normal usage. In addition to using ink to mar the edge of media, in response to tamper, other actions can be taken in meters that use other types of printer. For example, when a dot matrix or thermal transfer printer is used, the print ribbon can be cut or shredded, If tampering is sensed, in order to prevent further printing.

The meter tape (or magazine stack) can be locked securely in the meter and require a coded lock and key for installation and removal. The code used can correspond to the meter, the individual user, the amount of postage paid for, the maximum printed value, etc.

The meter can include card reading and writing features to permit a system's accounting features to transfer data to and from an inserted smart (active) or passive encoded card.

By ensuring that the amounts of postage printed correspond to the electrical drive signals (that there is no hysteresis in mechanical linkage, no offset in position, etc.), there can be no discrepancy between the value of stamps printed and the amount of postage accounted for in the charge register or accumulator. By using non-volatile, one-way storage devices—write once or read once memory—printing can be limited to amounts of postage paid.

The use of partially pre-printed postal meter material provides a secure basis for providing portable, hand-held postage meters. Because this also simplifies their printing requirements, they can be produced inexpensively.

DETAILED DESCRIPTION

Figure 1:
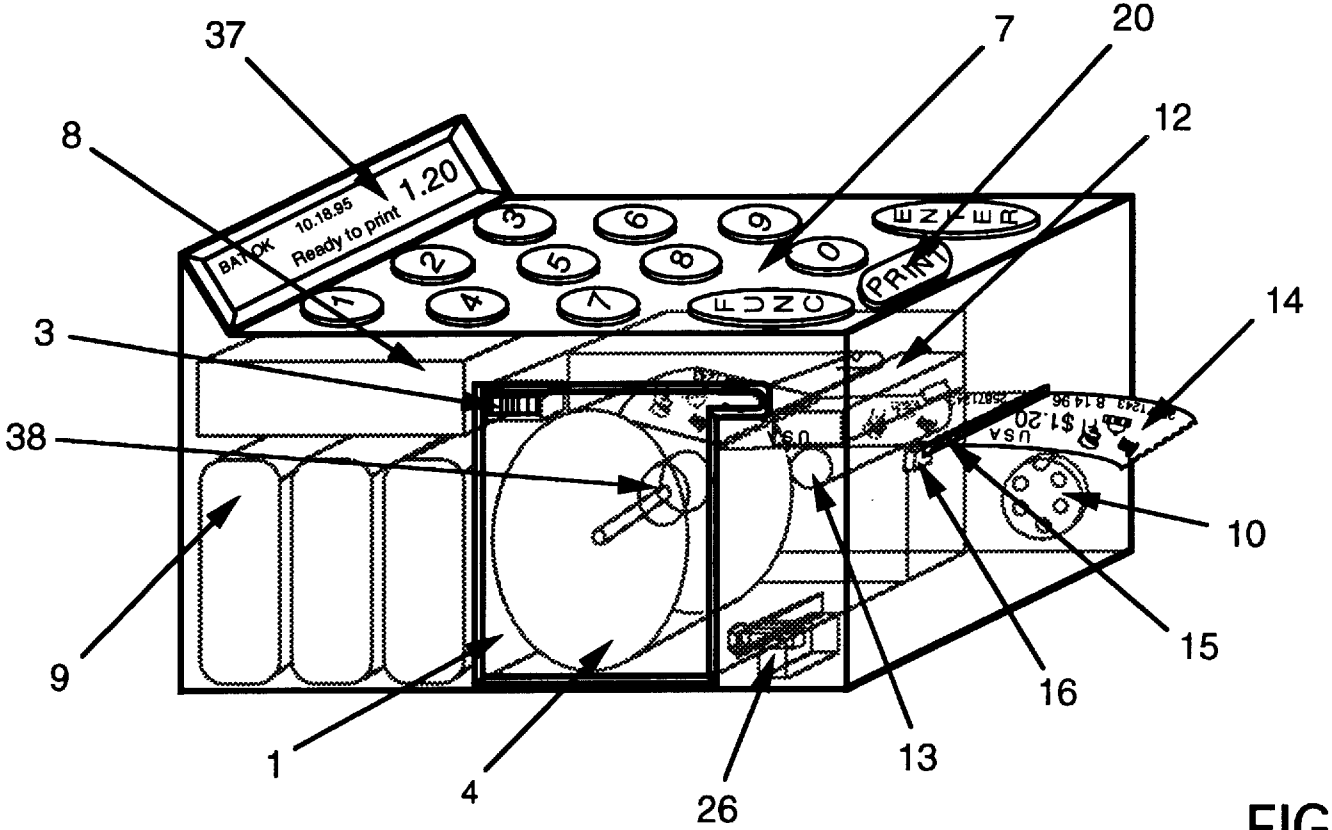
FIG. 1 is an open perspective detailed schematic depiction of a postage meter of the invention
Figure 2:
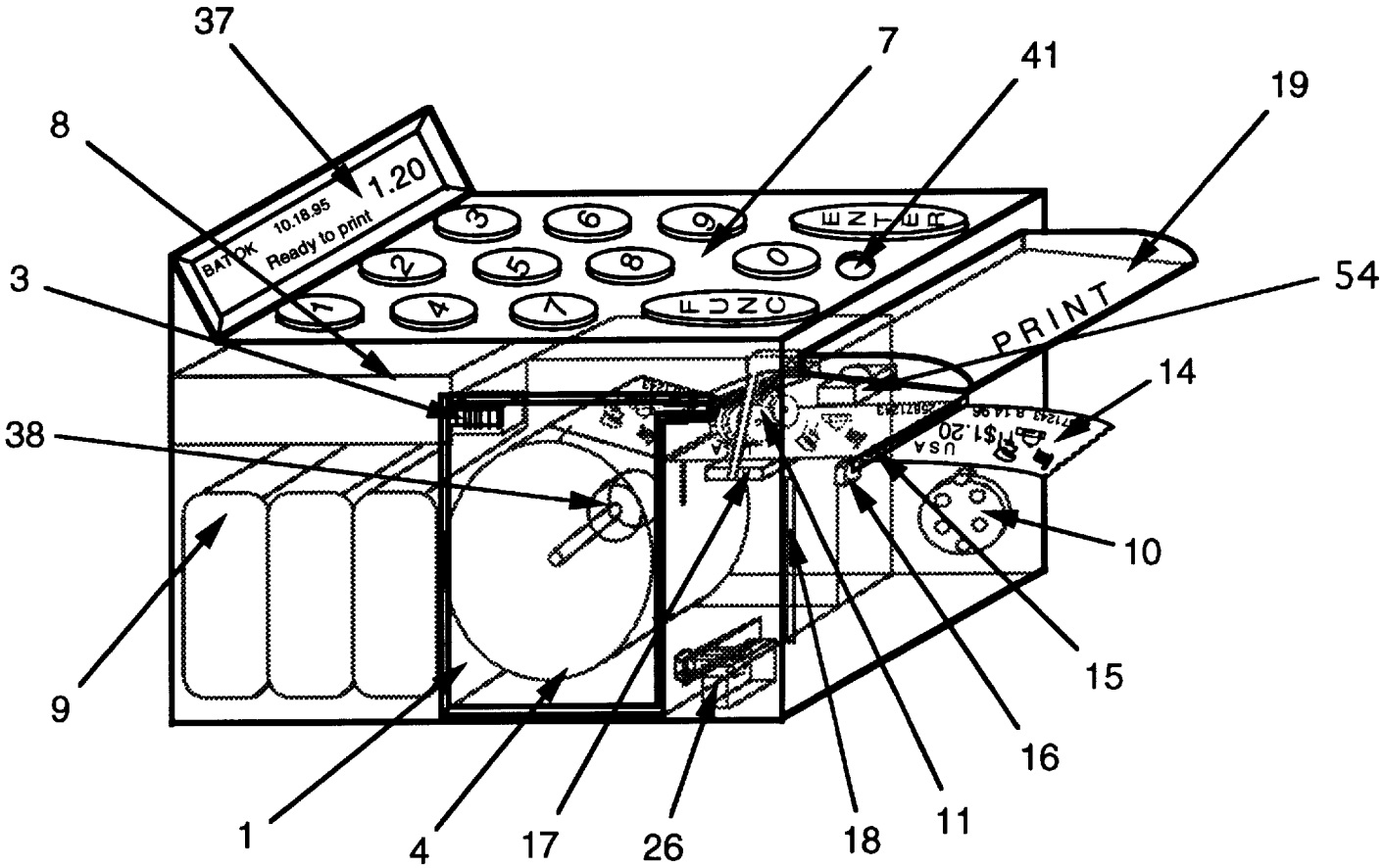
FIG. 2 is a similar depiction to that in FIG. 1 of a postage meter employing print wheels and manual actuation

FIGS. 1 and 2 show a particular embodiment of a postage meter of the present invention. Various features used to enter and display data, compute the required postage, print the selected data on the tape, securely provide a roll of pre-printed meter tape in a cartridge, etc. are shown in phantom by lighter lines or are omitted to avoid clutter in the drawing. As described below, FIGS. 1 and 2 differ in that the print means shown in FIG. 1 are general, while inked mechanical print wheels with raised type are shown in FIG. 2.

The removable cartridge, 1, is shown held in place by the cartridge lock, 26. The cartridge has a lock, 3, and key, 24 (both shown in FIG. 3*a* and FIG. 3*b*). This arrangement is used to protect against unauthorized removal of a cartridge and to allow authorized removal without damage to the meter or invalidation of the meter tape. The security lock arrangement can be based upon various known physical sensor technologies e.g., mechanical, optical, or electronic. Only when the proper key is inserted into the lock, as illustrated by 25 in FIG. 3*b*, will the held locking pin, 27, release and permit the cartridge to be pushed out of the meter body, 23. The means for accomplishing release of the locking pin are not shown and may be a mechanical linkage from lock, 3, or an electrical signal that actuates a solenoid, or other means known to those in the field. When a fresh cartridge of meter tape is inserted into the postage meter, the electronic accounting register(s) can be automatically initialized to zero (accumulative type) or, alternatively, to the value of stamps that the user has purchased (debit type); electronic means for accomplishing this can be within the body of the meter or within the cartridge.

The key, 24, is made up of a coded pattern of material that is located in a raised area on the front (leading) face of the cartridge. The lock, 3, is made up of a pattern of similarly-coded material that is located in a recessed area on the rear (trailing) face of the cartridge. These patterns can be formed from various materials, in various ways, known to those skilled in the art. Cost and reliability are the principal factors for determining the choice of particular means. Several possible examples are noted: a set of tiny magnets or magnetized areas could be distributed along a line, forming a sequence of north and south poles. The key and lock need to have the same magnetic pole pattern in order for a sensor, not described, to assert a match and release the locking pin. Alternatively, the pattern could be in a sequence of adjacent, mechanical tongue and grooves, of varying width and spacing. In this case, matching would be sensed by full penetration of the tongue, at the several points. Another alternative would use a sequence of optically opaque and transparent lines (bar code). Here, sensing would involve an optical correlation of the superposed patterns. Yet another way to provide a lock and key to control removal and replacement of a meter tape cartridge is with a coded card and card reader.

In each of these examples for ensuring that only authorized persons have access to a meter, not only would the key and lock control the release of the locking pin, 27, but their match is necessary for the microcomputer's operating system to function normally. For example, data entry on the key pad, 7, could be blocked.

The data encoded on the lock, 3, and key, 24, could correspond to a randomized, algorithmically-generated serial number, or to a sequential serial number that applies to that particular postage meter, or to the identity of the individual user. etc.

In the drawings, the removable cartridge, 1, is shown in rectangular cross-section, but other cross-sections, e.g., circular, pentagonal, etc., may also be used.

Figure 4A:
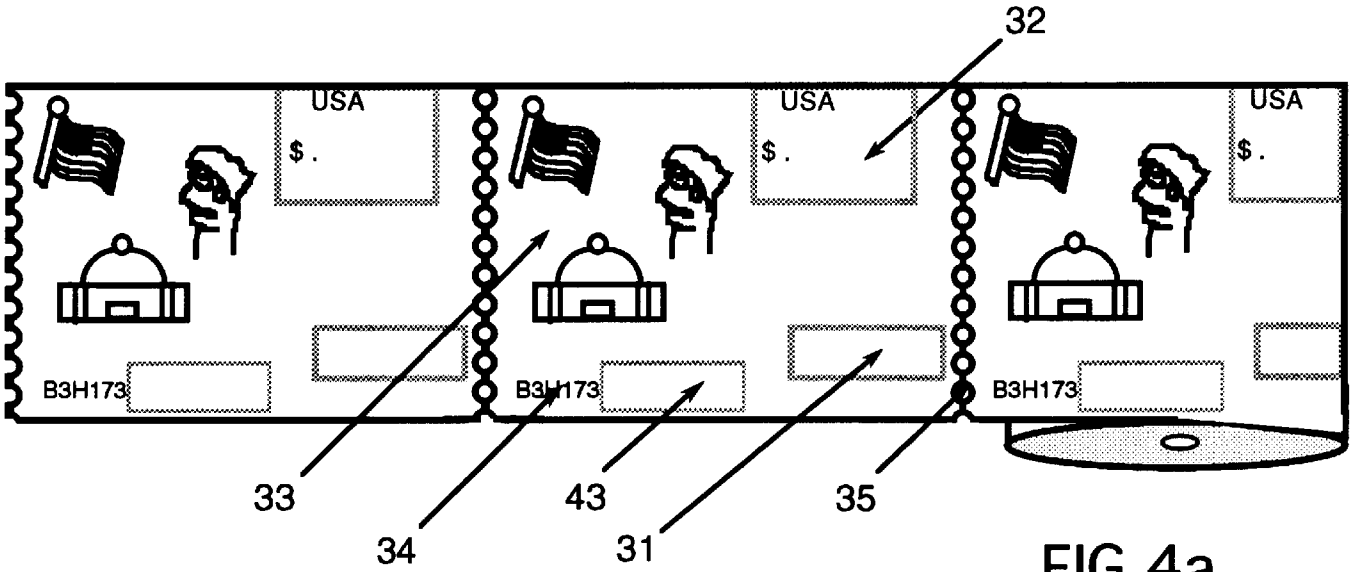
FIG. 4*a* shows a roll of partially pre-printed, commemorative postal meter tape

The present invention introduces the use of partially pre-printed, postal meter tape, shown in FIG. 4*a*, as a way to simplify and thus reduce the complexity and cost of printing means in hand-held, portable postage meters. This approach only requires that the postage meter be capable of printing numeric data in well-defined fields on the meter tape. However, printers with alphanumeric and/or graphic capability can also be used to advantage with pre-printed meter tape.

Pre-printed tape can include advanced micro-printed security means, for example, a hologram or other complex graphic. In addition, by restricting printing to the tape (as opposed to directly on a letter or package) and by only making the tape available in limited-access cartridges, security problems are greatly reduced.

Tape can be customized, much as personal checks are, to various historic or artistic issues, to zip code area, to individual patron message, etc. This continues the numismatic value of and can introduce new uses for postage stamps.

Commemorative meter tape can also be used in large, table top postage meters and postage dispensing machines, both within and without post offices.

Within the removable cartridge is a roll of postal meter tape, 4, preprinted by the Postal Authority with indicia for identification and security. These include the fact that it is postage of the United States or another country, and may include a serial number and/or other unique markings.

Protection against fraud can be enhanced further by printing serialized data on stamps. A number of schemes are possible, including the printing of sequential, random or algorithmically-derived characters and the use of various graphical patterns. Meters and/or individual stamps can be given a unique number to deter fraudulent printing and to facilitate a determination of its source.

Figure 4B:
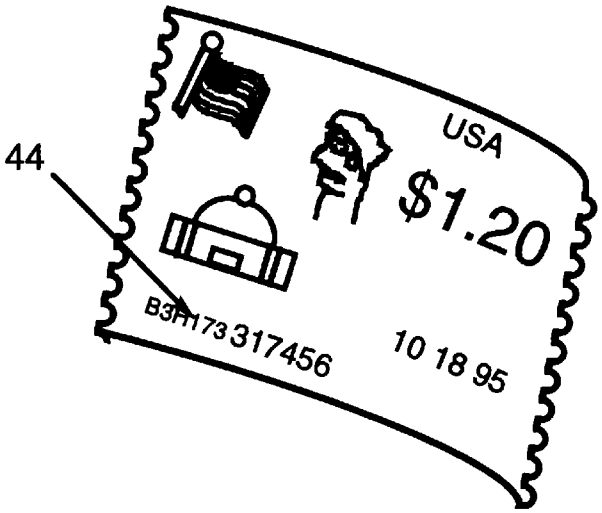
FIG. 4*b* shows a stamp as completed by action of the postage meter

The meter tape illustrated in FIG. 4*a* uses a sequential number approach. Each stamp is uniquely identified by a two part system. The first part of a stamp's serial number is shown in that figure as a pre-printed alphanumeric character string, 34, that is assigned to that particular meter. Since this field is pre-printed, it can consist of any print characters or could be a hologram or other microprinted graphic. The second part of the serial number is shown as an area, 43, to be printed by the meter. This number would be held in a non-volatile storage register in the meter. The register would be incremented each time a stamp is printed and would not be reset when a meter stamp cartridge is replaced or when the accounting register is set. The serial number 44 shown on the completed stamp in FIG. 4*b* shows the full serial number, comprising both printed fields, with the second field drawn slightly larger. In a simpler non-sequential approach, Postal Authority pre-prints a complete serial number.

Figure 3A:
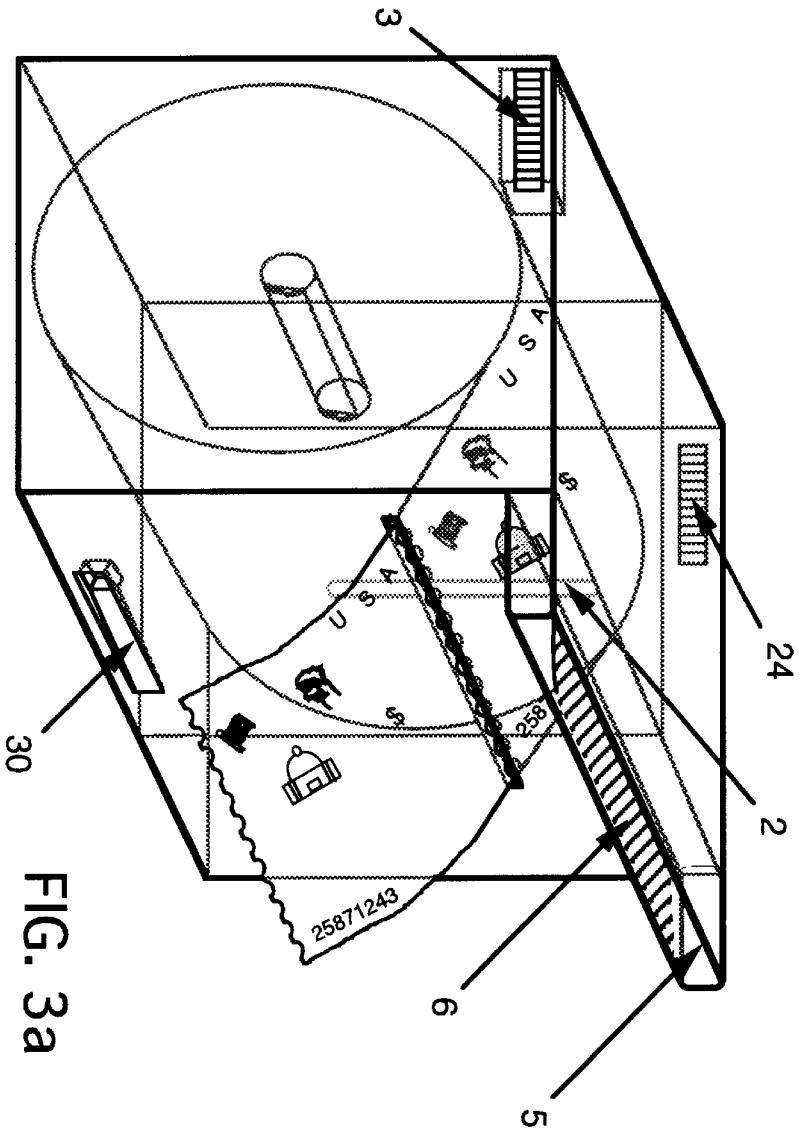
FIG. 3*a* shows a removable cartridge of postal meter tape

Referring to the embodiment shown in FIGS. 2 and 3*a*, there is an ink source, 5, which may be a pre-inked pad or a reservoir of ink to be delivered to an ink pad, 6, contained within the removable cartridge, 1, or within the body of the postage meter outside the cartridge. The ink pad contacts the top of the print wheels, 11, when the cartridge is inserted into the meter. The meter tape is fed, by means that are not shown, between the print wheels, 11, and the print platen, 17.

Referring to the embodiment in FIG. 1, the meter tape is fed, by means that are not shown, between the print head, 12, which in this instance prints the date and amount of postage, and the print roller, 13.

In either of the embodiments shown in FIGS. 1 and 2, the perforation finder, 16, senses the end of the tape and helps to determine the proper position for printing. The tape tension motor, 38, or other tension means, holds the tape taut so that there is good registration between the print head, 12 or the type on the print wheels, 11, and the areas of the tape to be printed upon. A postage meter might need to print on tape of several different sizes and shapes. This information can be communicated to the micro controller, in the electronics module, 8, in various ways that are known to those working within the art, and the movement of the tape would be adjusted, accordingly. The completed stamp, shown in FIG. 4*b*, is transported and ejected, or shown at 14, from the meter through the stamp exit opening, 15.

Miniature motors for positioning the print wheels, 11, in FIG. 2, as directed by entries on the key pad, 7, and for transporting the meter tape are not shown, but these means and methods are well understood in the art.

In FIGS. 1 and 2, when the proper amount of postage has been determined and entered, and the meter status is confirmed, the message, "ready to print," is displayed. In FIG. 2, the print handle, 19, raises both the print platen and the meter tape against the print wheels, 11. In this way, the selected data are printed in the correct areas of the stamp. The platen return tension spring, 18, restores the platen to its normal position so the completed stamp can be ejected from the meter. Other means to effect contact of print wheels with tape will be apparent to those skilled in the art. While mechanical, contact print means have been shown in FIG. 2 and are described in some detail here, many other types of printing means can be used. In a meter with a non-mechanical printer, printing can be actuated by the user pressing on the print handle, 19, and closing a switch (not shown) as in FIG. 2 or by pressing the "Print" key, 20, as shown in FIG. 1.

Our postage meter is described herein as hand-held because preferably it is of such size and weight. In the embodiments shown in the drawings, the meter may be held in the hand or it may be placed on a table for convenience in pressing the print handle or for weighing. The structures and functions described herein can, of course, be in more massive form for office table use.

The keys of the key pad, 7, which can be mechanical contact or proximity type, requiring the user to press or touch the selected keys. As shown in FIGS. 1 and 2, the key pad, 7, has a standard decimal digit layout, with two special keys that are labeled FUNC and ENTER, as well as a PRINT key, 20, in FIG. 1. Alternatively, data entry could be accomplished with sliding or rotating mechanical linkage positioning the print wheels, 11, in FIG. 2.

The key pad display, 37, which can be of the liquid crystal, light emitting diode, or other type, displays data as it is entered by the user with key strokes or as the result of micro controller calculation. Data can be displayed on the right, meter status messages on the left, and requests for user actions in the center, for uniformity.

When the FUNC and ENTER keys are pressed simultaneously, the meter toggles on and off. When the unit first comes on, status messages indicate the condition of the battery, controller, and readiness of the meter.

When the FUNC key is pressed, followed by one of the NUMERIC keys, a request for user action is displayed. For example, the following functions can be invoked, messages displayed, along with some user options in {brackets}:

| | | | |
|---|---|---|---|
| FUNC 1 | "enter date" | | |
| FUNC 2 | "enter postage amount" | | |
| FUNC 3 | "enter class of mail" | {1, 2, 3 . . . } | |
| FUNC 4 | "enter destination" {1 local, 2 domestic, 3 Canada, 4 Mexico, 5 foreign) | | |
| FUNC 5 | "enter weight in ounces" | } | pertains to meters with a built-in scale |
| FUNC 6 | "place item on scale" | } | |
| FUNC 7 | "insert cartridge key in lock" | | |

The ENTER key is pressed after data is entered on the key pad and the correct entry is seen on the display. Various other user and service functions can exist.

Alternatively, a postage meter could print alphabetic data in addition to the numeric described above. The print wheels in FIG. 2 would need to carry the additional type face. Another alternative for printing additional characters would be the use of a different printer type, such as dot matrix. The key pad would have to be replaced with a key board containing means to select the additional character set. Some economy in keys can be obtained through the use of "shift" keys, combinations of keys pressed simultaneously.

The simplest meter providing only for date and postage amount may be sufficient for residential or small business use dispatching first class letter mail predominantly or exclusively. Such customers can use a meter in which a single postage amount or two postage amounts (for example, one amount for the first ounce and another amount for each additional ounce) can be entered and set, thereafter requiring only the pressing of one or two keys as desired.

Figure 7:
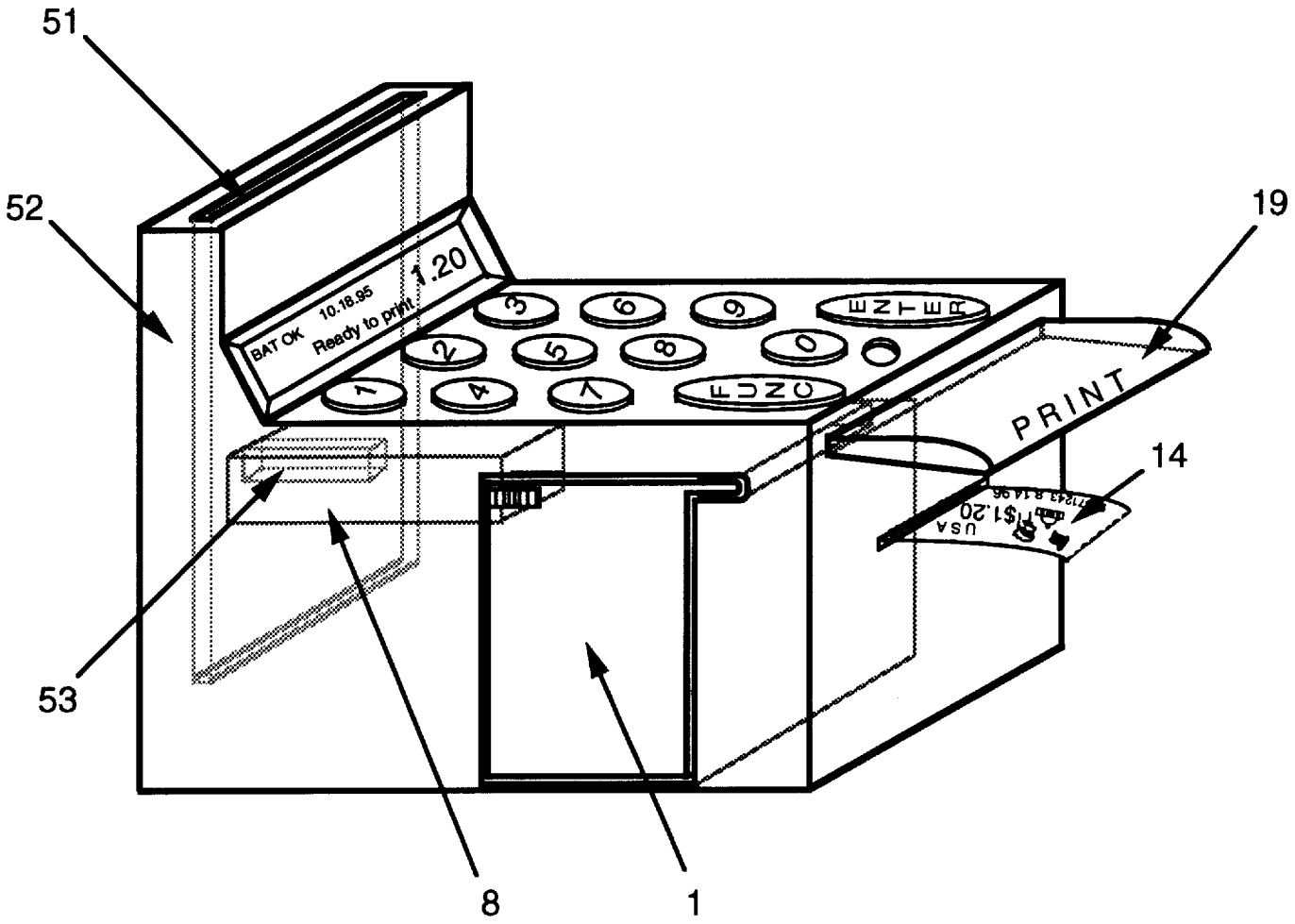
FIG. 7 shows a postage meter with a card reader.

Any meter in accordance with this invention can be provided with an internal electronic clock that automatically advances the date every 24 hours. This data is applied to the appropriate position on the meter tape at the same time that the postage amount and any other data are printed. FIG. 7 shows an internal electronic clock 53 within the electronics module 8.

The battery pack, 9, supplies all the energy to operate the postage meter, with the exception of the manual input applied to the print handle, 19, in FIG. 2, that energizes printing in meters that use contact printing. Nickel/metal hydride and other rechargeable batteries are known to the art. The battery pack or an outside source provide a transformer/rectifier to step-down the voltage and change AC to DC for recharging the batteries.

The electronics module, 8, contains regulators that supply the micro controller and other electrical devices: sensors and actuators, with correct voltage.

The micro controller performs the following functions for the postage meters shown in FIGS. 1 and 2:

- contains arithmetic and logic circuits interconnected with storage registers and both volatile and non-volatile storage circuits;
- accepts data as it is entered;
- formats messages for the display;
- computes the postage required from the entered data;
- positions the meter tape for printing and moves the printed stamp out the exit opening;
- sets selected data ready for printing;
- in meters with electrically-powered printers, actuates the print operation;
- after a stamp is printed and ejected from the meter, the accounting register, either in the instrument or in an inserted smart card is adjusted accordingly;
- contains non-volatile data, in read-only memory (ROM) relating to postage rates;
- other non-volatile memory, either of an electrically-alterable read only memory (EAROM) type or of a magnetic type, holds data related to accounting functions, which is updated after each stamp is printed;
- senses tamper of the meter and controls the disabling functions, such as, release of ink that would invalidate the roll of meter tape;
- maintains a calendar, provides for the entry of a date; and
- checks the status of components.

For the meter in FIG. 2, the following specific functions are performed:

- rotates the print wheels by micro motors (not shown) into correct position for the selected data; and
- rotates the type of the print wheels past the ink pad before displaying the message, "ready to print".

The service connector, 10, permits by means not shown, the charging of the battery pack, and can be used for service diagnostics or additional security.

Figure 3B:
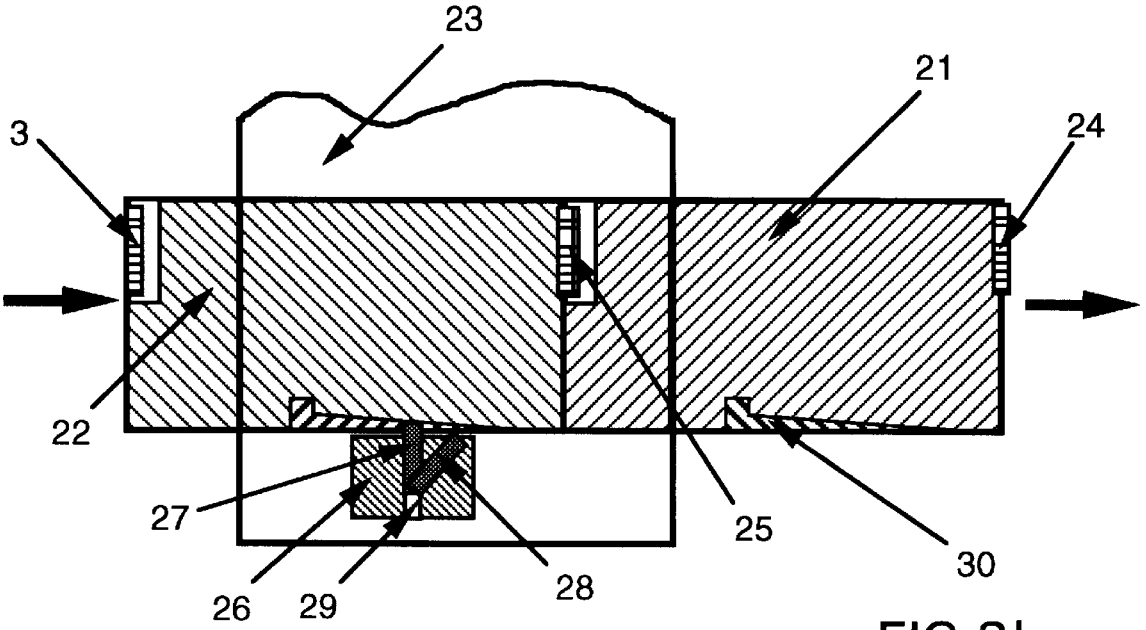
FIG. 3*b* is a plan view of a portion of the meter that illustrates the replacement of a cartridge

FIGS. 3*a* and 3*b* show the removable cartridge, 1, in greater detail. When a cartridge is inserted into the meter, the locking pin, 27, follows the groove in the locking pin guide, 30, under the force of the compressive spring, 29, and finally becomes fully seated. The lock, 3, includes: coded material on the rear face of the cartridge; a sensor to determine whether an inserted key, 24, produces a match. When a match exists, the sensor causes the release of the locking pin, 27. by means which are not shown. The locking pin, released, 28, permits the cartridge to be pushed out the opposing side of the meter.

Not shown in the figures is a sliding contact connector located in the side of the cartridge, and in the adjacent wall of the meter, that supplies electrical energy to and carries signal from the lock sensor. Other devices and signals might be located in the cartridge, rather than the meter, and require electrical connection. For example, the tape tension motor, 38, could be located in the cartridge.

FIG. 4*a* shows a roll of meter tape with printed commemorative graphics, 33, pre-printed partial serial number, 34, and pre-cut holes (perforation) 35. The area in which the date would be printed, 31, the second part of the serial number, 43, and the area in which the amount of postage is to be printed, 32, are also shown. Serial numbers on postage stamps can serve a number of different functions. In this preferred embodiment, each postage stamp has printed upon it a unique, sequential number. The pre-printed field, 34, is the number of that postage meter, while the field printed by the postage meter, 43 corresponds to a total count of the stamps printed by that meter.

Figure 5:
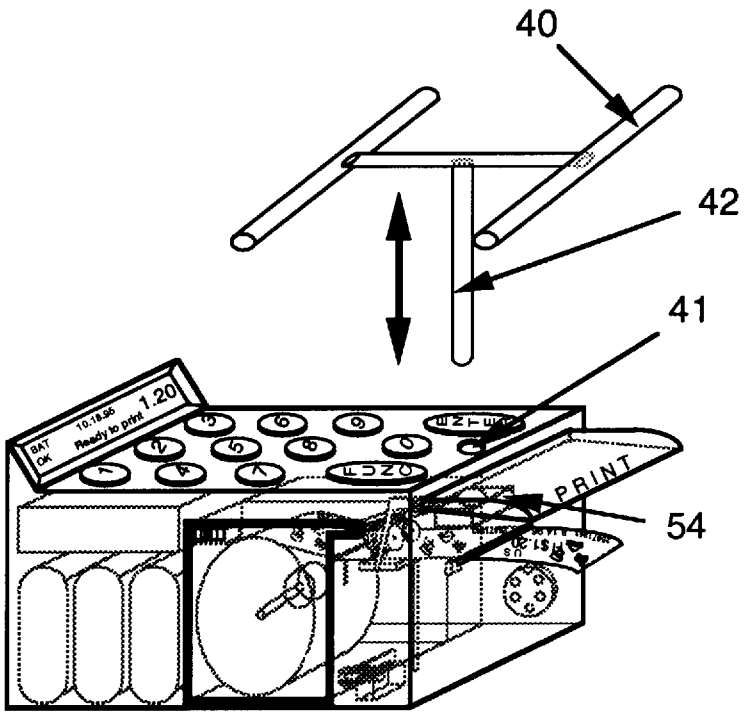
FIG. 5 shows the postage meter of FIG. 2 plus a removable platform (carrier) for weighing

Weighing means can be included as part of the postage meter of this invention; for example, an internal balance that generates an electrical measure proportional to the weight of the item being mailed. This may be as is illustrated in FIG. 5, where removable portable plastic carrier, 40, can be inserted into the meter through a small hole, 41, in the top face (also shown in FIG. 2). The carrier support, 42, applies the weight of a letter to be mailed plus the carrier's weight to a weighing transducer (not shown) in the postage meter. The transducer can be a semiconductor pressure sensor or another type transducer used in electronic balances, such as a photoelectric sensor that maintains a null point in a feedback loop. The weight of the carrier can be zeroed out as a preliminary tare value when the keys "FUNC" and "6" are pressed simultaneously. In its simplest form, the user reads the weight read from display, 37, and determines the postage required. Preferably, the amount of postage is calculated internally from the electrical measure when the meter is set for a constant postage amount per unit weight. Or class and destination can be entered manually from the key pad for a more comprehensive calculation. Conventional means are known for making such calculations. Rather than having an internal balance, the meter can be connected to an external scale that generates such electrical measure, or a reading can be taken and entered manually on the postage meter.

Figure 6:
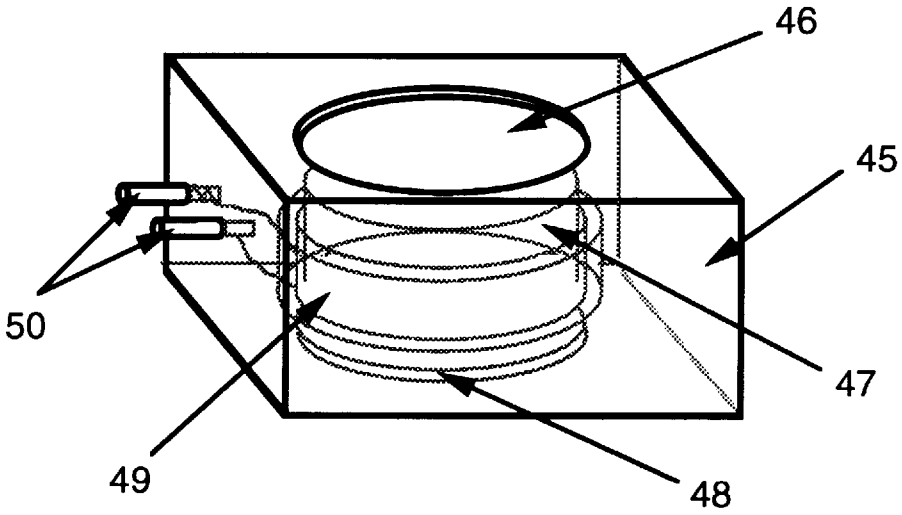
FIG. 6 shows a balance employed internally for weighing an item to be mailed.

One form of a conventional balance that can be used within the postage meter by being placed directly under hole 41 of FIG. 5 is shown in enlarged form in FIG. 6, having a housing 45, an opening 46 for receiving carrier 40, a ferrous piston 47 movable vertically against compression spring 48 in accordance with the weight of the postal item. An electrical measure proportionate to the weight is generated within coil 49 having terminals 50 for connection to the relevant circuitry within the electronics module 8.

As described earlier, an encoded data card, either of a passive or active type, can be used to enable the postage meter and/or to perform accounting functions. A meter adapted for this use is shown in FIG. 7, with a slot 51 for inserting the card into card reader 52, which is connected internally with the electronics module 8.

We claim:

1. A postage meter, comprising:

(a) a mechanically secure housing having an opening for dispensing stamps;

(b) within said housing, a supply of identical partially-printed separate postal stamps having on each stamp pre-printed indicia for identification and security and blank spaces for receiving further printing;

(c) means for printing the date and desired amount of postage on said blank spaces;

(d) means for dispensing the thus-printed stamp;

(e) a descending charge register or an accumulator;

(f) means restricting to postal authority only, the ability to set the charge register at or to limit the accumulator to the total amount of postage paid, or to be paid;

(g) means to debit the charge register or augment the accumulator with the amounts printed on successive stamps; and (h) means to disable further operation of the postage meter when available postage is exhausted.

2. A postage meter according to claim 1, wherein the date is printed according to an internal electronic clock.

3. A postage meter according to claim 1, of such size and weight as to be hand-held.

4. A postage meter according to claim 1, wherein said charge register or accumulator, or the amounts registered or accumulated therein, are contained in an insertable active data card.

5. A postage meter, comprising:

(a) a mechanically secure housing having an opening for dispensing stamps;

(b) within said housing, a supply of identical partially-printed separate postal stamps carrying adhesive on one side, and on the other side having on each stamp pre-printed indicia for identification and security and blank spaces for receiving further printing;

(c) means for entering the date and desired amount of postage;

(d) means for printing the date and desired amount of postage on said blank spaces;

(e) means for dispensing the thus-printed stamp;

(f) a descending charge register or an accumulator;

(g) means restricting to postal authority only, the ability to set the charge register at or to limit the accumulator to the total amount of postage paid, or to be paid;

(h) means to debit the charge register or augment the accumulator with the amounts printed on successive stamps; and (i) means to disable further operation of the postage meter when available postage is exhausted.

6. A postage meter, comprising:

(a) a mechanically secure housing having an opening for dispensing stamps;

(b) a cartridge within said housing containing a roll of postal tape comprising sequential identical partially-printed separable postal stamps, said postal tape carrying adhesive on one sides and on the other side having on each stamp pre-printed indicia for identification and security and blank spaces for receiving further printing;

(c) means for entering the date and desired amount of postage;

(d) means for printing the date and desired amount of postage on said blank spaces;

(e) means for advancing the postal tape and dispensing the thus-printed stamp;

(f) a descending charge register or an accumulator;

(g) means restricting to postal authority only, the ability to set the charge register at or to limit the accumulator to the total amount of postage paid, or to be paid;

(h) means to debit the charge register or augment the accumulator with the amounts printed on successive stamps;

(i) means to disable further operation of the postage meter when the available postage is exhausted; and (j) locking means restricting only to postal authority the ability to remove or replace said cartridge and to reset said charge register or set said accumulator.

7. A postage meter according to claim 6, wherein said printing means prints by contact, and said cartridge contains means to apply ink to the printing means.

8. A postage meter according to claim 6, wherein the item to be mailed is weighed with an internal balance and a proportionate electrical measure is obtained.

9. A postage meter according to claim 8, wherein the amount of postage is calculated using said electrical measure and the class and destination as entered manually from the keyboard.

10. A postage meter according to claim 8, wherein said balance is positioned under a hole in the top of the meter into which a portable support for the item to be weighed is inserted so as to interact with the balance.

11. A hand-held postage meter, comprising:

(a) a mechanically secure housing having opposed openings for respectively insertion and removal of a tape cartridge, and an opening for dispensing stamps;

(b) a cartridge containing a roll of postal tape comprising sequential identical partially-printed separable postal stamps, said postal tape carrying adhesive on one sides and on the other side having on each stamp pre-printed indicia for identification and security and blank spaces for receiving further printing;

(c) means for entering the date and desired amount of postage;

(d) means for printing the date and desired amount of postage on said blank spaces;

(e) means for advancing the postal tape and dispensing the thus-printed stamp;

(f) a descending charge register or an accumulator;

(g) means restricting to postal authority only, the ability to set the charge register at or to limit the accumulator to the total amount of postage paid, or to be paid;

(h) means to debit the charge register or augment the accumulator with the amounts printed on successive stamps;

(i) means to disable further operation of the postage meter when available postage is exhausted; and (j) locking means restricting only to postal authority the ability to remove or replace said cartridge and to reset said charge register or set said accumulator.

12. A postage meter according to claim 11, wherein the ends of a cartridge that is in place form a tight seal with the outside surfaces of the housing.

13. A postage meter according to claim 11, wherein a used tape cartridge is removed from the meter through one of said openings by being pushed out by a new cartridge entering through the opposite opening.

14. A postage meter according to claim 13, wherein the locking means can only be unlocked by insertion of a key that is an integral part of a new cartridge.

15. A postage meter according to claim 14, wherein said key is a mechanical probe at the entering face of a new cartridge that by insertion into a corresponding receptor cavity in the rear face of the used cartridge unlocks the locking means, allowing the used cartridge to be pushed out and replaced by the new one.

16. A postage meter according to claim 14, wherein said key is a probe on the entering face of a new cartridge that makes contact with an electrical or magnetic or optical receptor on the rear face of the used cartridge, thereby unlocking the locking means, allowing the used cartridge to be pushed out and replaced by the new one.

17. A postage meter according to claim 14, wherein unlocking by insertion of said key permits resetting of the charge register or accumulator.

18. A postage meter according to claim 14, wherein the means for entering date and desired amount of postage comprises an electronic numerical key pad.

19. A postage meter, comprising:

(a) a mechanically secure housing having an opening for dispensing stamps;

(b) within said housing, a supply of identical partially-printed separate postal stamps having on each stamp pre-printed indicia for identification and security and blank spaces for receiving further printing;

(c) means for printing the date and desired amount of postage on said blank spaces;

(d) means for dispensing the thus-printed stamp;

(e) a descending charge register or an accumulator;

(f) means restricting to postal authority only, the ability to set the charge register at or to limit the accumulator to the total amount of postage paid, or to be paid;

(g) means to debit the charge register or augment the accumulator with the amounts printed on successive stamps;

(h) means to disable further operation of the postage meter when available postage is exhausted; and (i) means to disable operation upon tampering by an unauthorized person.

20. A postage meter according to claim 19, having an ink reservoir, and means to discharge ink at a disabling location upon tampering.

21. A postage meter according to claim 20, wherein ink when discharged spreads over the edge of the postal partially pre-printed postal stamps rendering any stamps made therefrom invalid.

* * * * *